United States Patent [19]

Bechtold

[11] Patent Number: 4,968,177

[45] Date of Patent: Nov. 6, 1990

[54] MODULAR BARRICADE

[76] Inventor: Joseph Bechtold, 1046 Lighthouse Dr., Schaumburg, Ill. 60193

[21] Appl. No.: 440,265

[22] Filed: Nov. 22, 1989

[51] Int. Cl.[5] ..... E01F 13/00

[52] U.S. Cl. ..... 404/6; 404/9; 256/13.1; 256/64; 116/63 P; 116/63 T

[58] Field of Search ..... 116/63 R, 63 P, 63 T; 404/6, 7, 9, 10, 12, 13, 14; 256/13.1, 64

[56] References Cited

U.S. PATENT DOCUMENTS 4,071,224 1/1978 Gilbert ..... 116/63 P

*Primary Examiner*—Ramon S. Britts
*Assistant Examiner*—Roger J. Schoeppel
*Attorney, Agent, or Firm*—Douglas B. White

[57] ABSTRACT

There is provided a modular barricade which is composed of a plurality of interchangeable parts. A standardized section is used to form the frame mounting, and extensible crossbar is mounted to adjust the barricade to a variety of widths.

7 Claims, 2 Drawing Sheets

MODULAR BARRICADE

BACKGROUND OF THE INVENTION

1. Field of the Invention

This invention relates generally to barricades used as warning apparatus, and particularly to those of the type that present laterally oriented crossbars bearing warning indicia. More particularly the invention relates to collapsible apparatus designed to improve its storage and repair capabilities.

2. Description of the Prior Art

Prior barricades of the type which present lateral crossbars are of the "A" frame design or "L" frame design with the crossbar(s) rigidly affixed to the frames. Because of the nature of the construction of these barricades, multiple sizes must be inventoried to accommodate the variety of uses encountered and to replace damaged barricades; and this inventory requires substantial storage space.

Barricades generally sustain regular damage due to their location proximate moving traffic, and they are easily damaged beyond repair when struck by vehicles. As a result, recent innovations have been directed to improving their crash worthiness. In U.S. Pat. No. 4,183,695, a signboard style barricade is mounted to its base via breakaway shear pins. In the event of impact, the supporting legs easily collapse. More recently in U.S. Pat. No. 4,792,258, another collapsible structure is provided but with a locking mechanism designed to hold it down after the collision.

SUMMARY OF THE INVENTION

The present invention provides a modular barricade which may be disassembled when placed in storage and which is composed of a plurality of interchangeable parts; standardized modular sections are used to form the many parts of the frame mounting. An extensible crossbar is then mounted in the barricade to adjust the width of the crossbar to a variety of sizes. Moreover, when any frame section is damaged on a barricade, a limited inventory of the standardized section and the few other parts will usually suffice to accomplish the repair.

BRIEF DESCRIPTION OF THE DRAWINGS

FIG. 2 is a perspective view of an "A" shaped barricade in accordance with the present invention.

Figure 1:
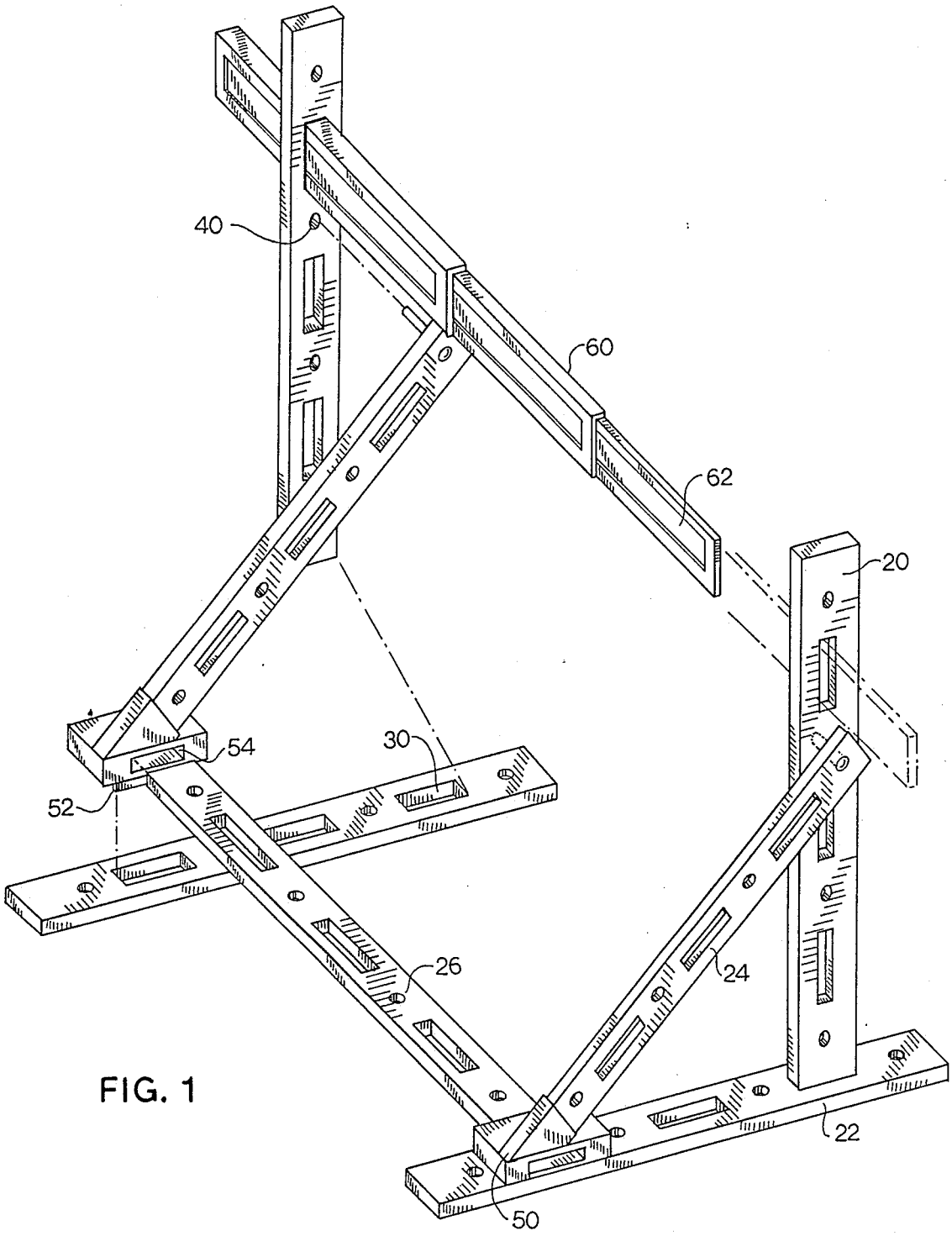
FIG. 1 is a perspective view of an "L" shaped barricade, partially exploded, in accordance with the present invention.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

In accordance with the present invention there is shown in FIG. 1 an "L" shaped barricade of modular design and adaptable to various widths. Particularly, this version is constructed of seven identical standards, forming the uprights 20, the base 22, the truss 24 and the stabilizer 26. Positioned between four holes there are three slots 30 formed in each standard and sized to accept the inserted ends of a perpendicularly positioned standard. In this fashion the upright may be engaged with the base member by insertion of one extremity thereof into the slot. Further support of the upright is provided with the truss member 24 pinned to the upright at a hole 40 therein, The pinned connection may be accomplished through nut/bolt attachment means or any suitable equivalent. Supporting the lower end of the truss member there is provided an angular engagement member 50 arranged to encompass the lower end of the truss. On its bottom there is provided a tab 52 which is sized to fit securely into the slot of the base standard. This engagement member also presents a transverse slot 54 to accept the ends of the stabilizer standard 26.

One, two or three cross bar members 60 may be positioned through the slots of the uprights. This cross bar is preferably of a telescoping design and carries reflective material 62 on its sides. The cross sectional dimension of the bar is such that it fits easily through the slot in the upright and may be extended to any desired width. When the crossbar is extended beyond the width of the barricade (as defined by the base width) it will extend beyond the slot in the upright. However, it is also possible to extend the upright/base combination if the stabilizer is not fitted into place, but this is not the preferred arrangement.

In a similar embodiment and in accordance with the invention there is shown in FIG. 2 an "A" shaped version of the telescoping barricade. This device is composed of identical end pieces 70 formed in an "A" shape and having a bottom stabilizing member 72 and an upper cross bar supporting panel 74. This upper panel is arranged with a slot 76 sufficiently dimensioned to receive the telescoping cross bar 80. When set up, the cross bar displays reflective material 82 and may be extended through the end pieces (or the end pieces may be spread) to achieve the desired width. Since there is no stabilizing member between the opposing end pieces, the crossbar performs the stabilizing function. Accordingly, the end pieces may be spread further apart, or the crossbar may extend past the end pieces, as one may prefer.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A modular barricade apparatus comprising:

a crossbar member; and apparatus for supporting said crossbar comprising paired vertical members, and base members connected to said vertical members to hold said vertical members in a rigid upright position, wherein said base and said vertical members are interchangeable.

2. The modular barricade apparatus of claim 1 further comprising truss members affixed at their extremities to said vertical and said base members, wherein said truss members, said vertical members, and said base members are interchangeable.

3. The modular barricade apparatus of claim 1 wherein said crossbar is comprised of an extensible telescoping member and wherein said crossbar is mounted to said vertical members by extending said crossbar to project through openings in said vertical members.

4. The modular barricade apparatus of claim 2 wherein said crossbar is comprised of an extensible telescoping member and wherein said crossbar is mounted to said vertical members by extending said crossbar to project through openings in said vertical members.

5. The modular barricade apparatus of claim 1 further comprising a stabilizing member arranged to interconnect said base members, wherein said stabilizer member is interchangeable with said base and said vertical members, and wherein said stabilizer member is connected to said base members by means of tab members arranged to mate with openings in said base members.

6. The modular barricade apparatus of claim 5 further comprising truss members connected to said vertical and base members, wherein said truss members, said vertical members, said stabilizer members, and said base members are interchangeable.

7. The modular barricade apparatus of claim 5 wherein said crossbar is comprised of an extensible telescoping member and wherein said crossbar is mounted to said vertical members by extending said crossbar to project through openings in said vertical members.

* * * * *